United States Patent [19]

Lang

[11] 4,217,069

[45] Aug. 12, 1980

[54] DEVICE FOR AUTOMATICALLY RECEIVING SHEETS IN A PILE AND FOR REMOVING A PILE OF SHEETS FROM A SHEET PROCESSING APPARATUS

[75] Inventor: Pierre Lang, Ecublens, Switzerland

[73] Assignee: J. Bobst & Fils, S.A., Lausanne, Switzerland

[21] Appl. No.: 902,805

[22] Filed: May 4, 1978

[30] Foreign Application Priority Data

May 17, 1977 [CH] Switzerland ..... 006117/77

[51] Int. Cl.[2] ..... B65G 57/03

[52] U.S. Cl. ..... 414/45; 100/152; 100/218; 198/424; 414/101

[58] Field of Search ..... 414/29, 35, 43, 45, 414/47, 48, 49, 50, 70, 71, 72, 73, 91, 101; 198/422, 424, 426, 575, 601; 100/151, 152, 218

[56] References Cited

U.S. PATENT DOCUMENTS

| | | | |
|---|---|---|---|
| 3,226,112 | 12/1965 | Kuever . | |
| 3,297,318 | 1/1967 | Knecht . | |
| 3,433,372 | 3/1969 | Galloway | 414/45 X |
| 3,643,822 | 2/1972 | Birchall | 414/45 X |
| 3,688,920 | 9/1972 | Frish | 414/45 |
| 3,986,620 | 10/1976 | Wilde et al. | 414/49 |

FOREIGN PATENT DOCUMENTS

| | | | |
|---|---|---|---|
| 1368986 | 6/1964 | France | 414/43 |

*Primary Examiner*—Frank E. Werner

*Attorney, Agent, or Firm*—Hill, Van Santen, Steadman, Chiara & Simpson

[57] ABSTRACT

A device for automatically receiving sheets in a pile at a delivery station of a sheet processing apparatus and for removing a completed pile of sheets characterized by a first conveyor device for transporting a pallet along a vertical path and including a device for lowering the pallet along the vertical path as the sheets are deposited at the delivery station and received thereon, and a second conveyor device for transporting a pallet in a horizontal path between at least two positions with one of said positions in the path of the first conveyor and the other position removed therefrom. Preferably, the second conveyor extends perpendicular to the path of the first conveyor and has three positions arranged in a row with the middle position being the one position in the path of the vertical path of the first conveyor so that as a pallet is removed from the first conveyor to an unloading position, an empty pallet in a ready position is moved into the path of the first conveyor.

12 Claims, 14 Drawing Figures

DEVICE FOR AUTOMATICALLY RECEIVING SHEETS IN A PILE AND FOR REMOVING A PILE OF SHEETS FROM A SHEET PROCESSING APPARATUS

BACKGROUND OF THE INVENTION

1. Field of the Invention

The present invention is directed to a device for automatically receiving sheets in a pile at a delivery station of a sheet processing apparatus and for removing a complete pile of sheets from the processing machine, for example, a platen press.

2. Prior Art

In presently known platen presses, the processed sheets are delivered to a delivery station where they are accumulated in a pile on a pallet which is usually carried on a conveyor device that gradually lowers the pallet as the height of sheets deposited in the pile increases. When the pile of sheets reaches a given height, a retaining or interception device at the delivery station of the press, which device may be retractable fingers or retractable belts, is positioned to catch the sheets, which are continued to be deposited, as the pallet with the stack of sheets thereon is removed. The sheets held by the retaining device will build up into a pile, which has a rather low maximum height of about 10–15 cm, which height is determined by machine design considerations and the operational reliability of the sheet interception or retaining device. If the pile in the retaining device reaches the maximum height, a detecting device, which may be a photoelectric cell which checks the height of the piles of sheets in the retaining device, will cause the platen press to stop and thus interrupt production of the press. The full pallets are usually removed by means of a hand truck or lifter and then a new empty pallet is placed in the vertical conveying device to be raised to a position close to the sheet interception device to receive the sheets accumulated therein. When the new pallet is in the upper position, the interception device will retract and deposit the sheets accumulated thereon on the new pallet whereupon additional sheets conveyed to the delivery station of the press then accumulated on the new pile on the newly positioned pallet.

The above described delivery device does, however, have several drawbacks. For example, it cannot be unloaded quick enough when the platen press operates at a high speed and, therefore, the press is shut down or stopped due to exceeding an allowable height of the retained pile in the retaining or interception device. Therefore, all the advantages of the augmented operating speeds of the platen press are nullified by the frequent stops, which occur due to exceeding of the maximum height of the pile of sheets in the interception device during the removal of the full pallet.

SUMMARY OF THE INVENTION

The present invention is directed to providing a device that enables a quick and automatic delivery and removal of full pallets located at the delivery station and to thereby accomplish the transfer within the time allotted for the removal of a full pallet from the vertical conveyor and its replacement with an empty pallet.

These tasks are accomplished by a device for automatically receiving sheets in a pile at a delivery station of a sheet processing apparatus such as a platen press and removing a completed pile of sheets, said device including a first conveyor means for transporting a pallet along a vertical path and including means for lowering the pallet along said vertical path as the sheets are deposited at the delivery station and received thereon; and a second conveyor means for transporting a pallet in a horizontal path between at least two positions with one of said positions being in the path of the first conveyor and the other position being removed therefrom, said second conveyor means including two side frames supporting a running track therebetween, at least two plates disposed on said track for transporting a respective pallet therealong, drive means for transporting said plates along said track, stop means disposed at each end of said track for bringing each plate to rest at the end of the track, said plates and drive means having releasable means coacting to center the plates on said track and to interconnect the plates with the drive means, said first conveyor means having means for engaging a plate positioned in said one position and lifting the plate and pallets supported thereon from said second conveyor for transportation along said vertical path, and said second conveyor means having means for controlling the drive means of the second conveyor means so that the plate with pallets are moved into and out of said one position to be engaged by the first conveyor.

Preferably, the second conveyor means moves the plates along the running track between three positions with a second position being on one side of the one position and being a standby position for a plate containing an unloaded pallet and the third position being on the opposite side of said one position and being an unloading station for unloading a loaded pallet. The drive means, which preferably uses an electric motor operable in two directions, is operable in one direction to unload a plate and loaded pallet from the one position to the third position and simultaneously move an unloaded pallet on a second plate from the second position to said one position for engagement by the conveyor. Subsequently, after the plate and unloaded pallet have been elevated and after the loaded pallet has been removed and replaced with an empty pallet, the plate with the empty pallet is moved in the opposite direction from the third position through the one position to the second position to be in standby for subsequent loading on the conveyor.

Figure 13:
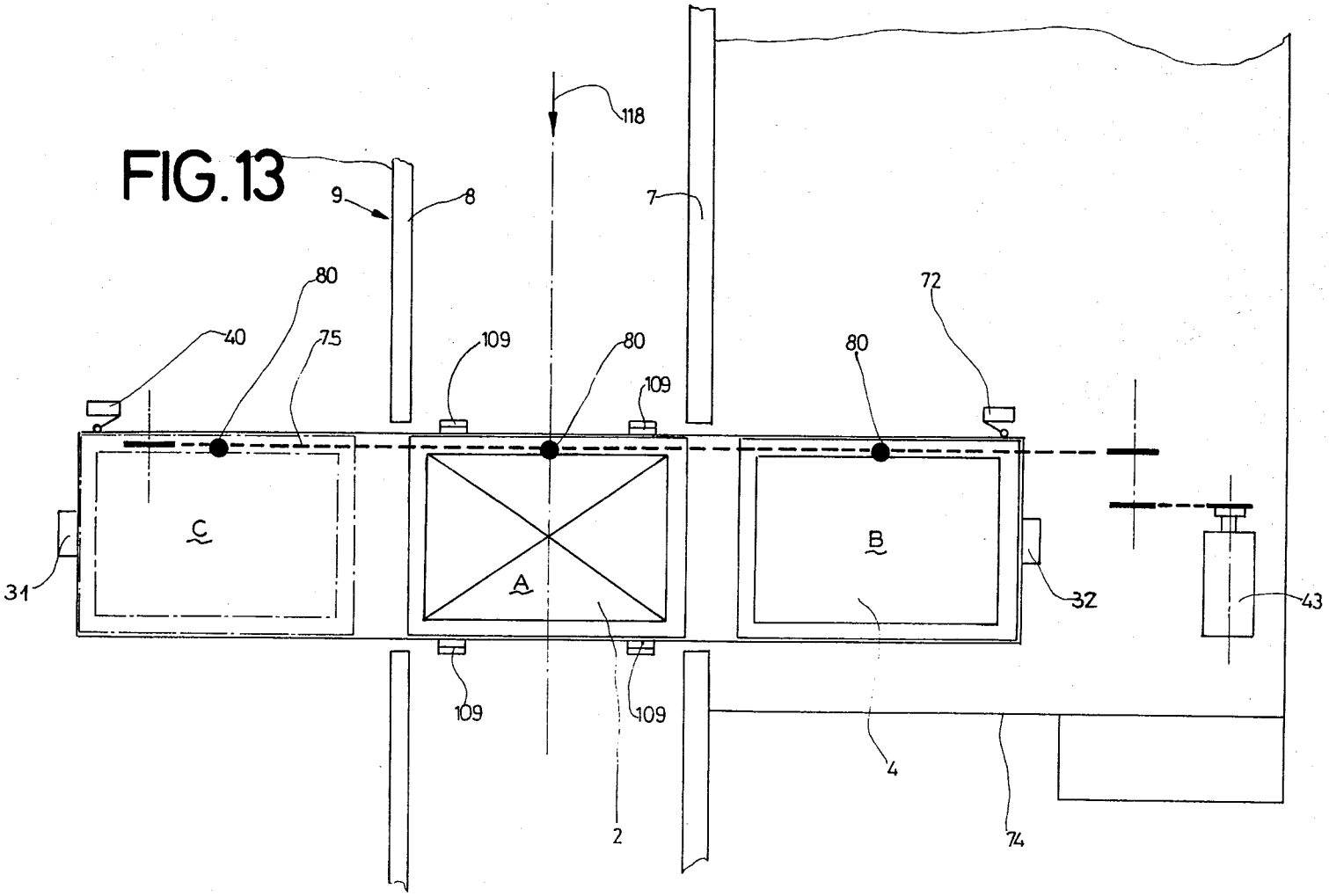
Figure 14:
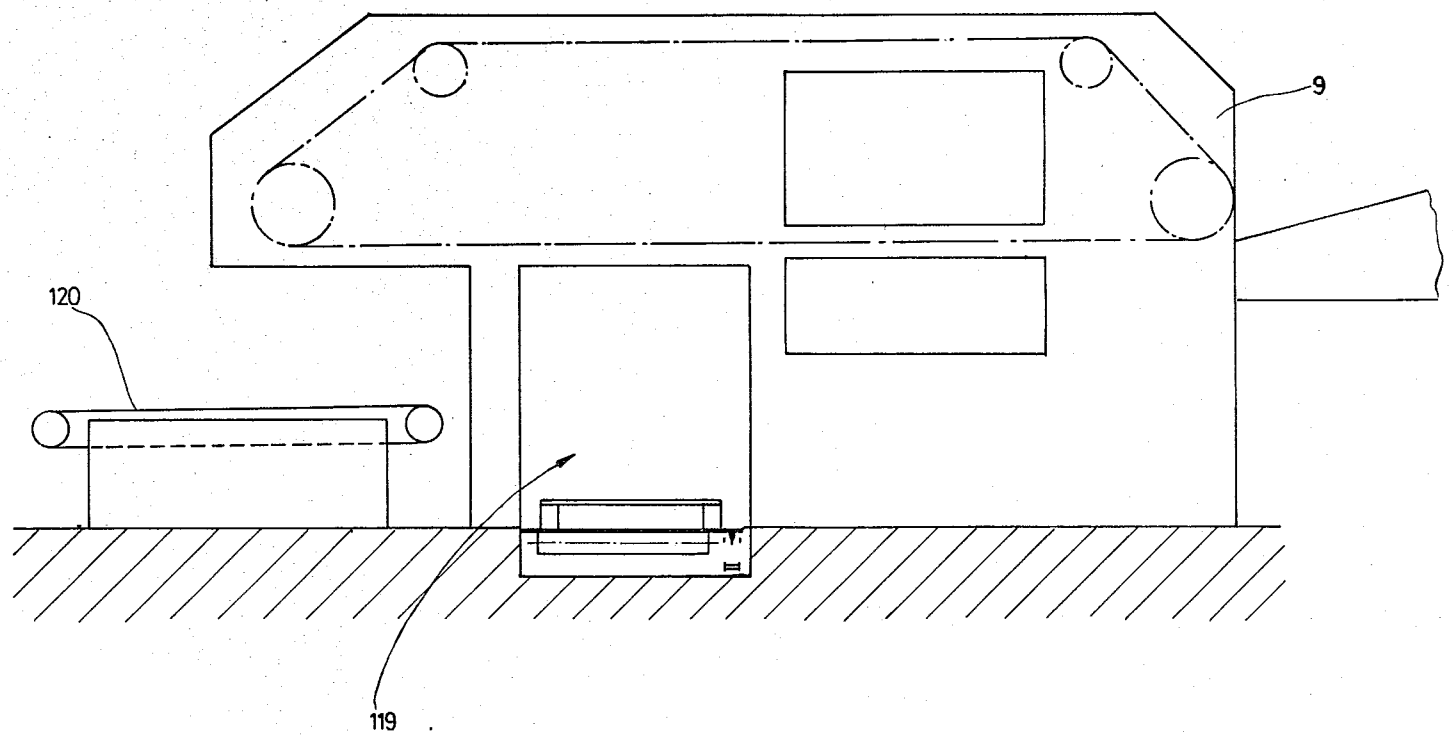

FIG. 13 is a schematic plan view illustrating the various positions of the parts during various steps of the operation; and FIG. 14 represents a platen press equipped with the device in accordance with the present invention.

DESCRIPTION OF THE PREFERRED EMBODIMENTS

The principles of the present invention are particularly useful when incorporated in a device, generally indicated at 119, for automatically receiving sheets in a pile at a delivery station of a sheet processing apparatus such as a platen press 9 (FIG. 14), and for removing a completed pile of sheets from the press 9. The platen press 9 may be of a type having continuous chains, which transport sheets through various stations such as a die cutting platen and a stripping device to the delivery station for depositing on a pallet. Waste material may be conveyed from the press 9 by conveyors such as 120.

Figure 1:
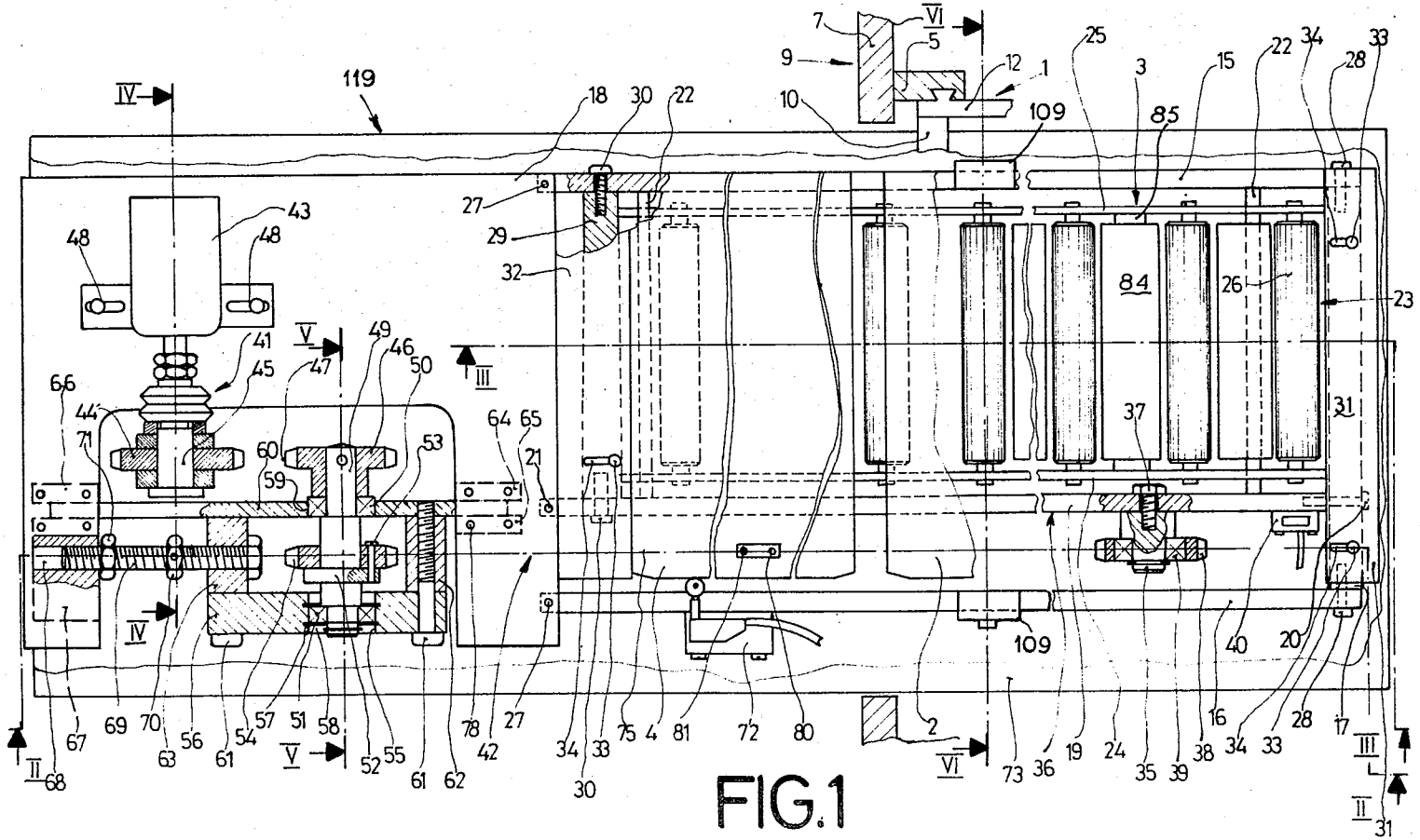
FIG. 1 is a plan view of the device of the present invention with portions broken away from purposes of illustration.

The device 119, as best illustrated in FIG. 1, comprises a first conveyor means 1, which moves a plate 2 supporting a pallet in a vertical direction and a second conveyor 3, which is arranged to transport plates such as 2 and 4 backward and forward in a horizontal plane.

Figure 3:
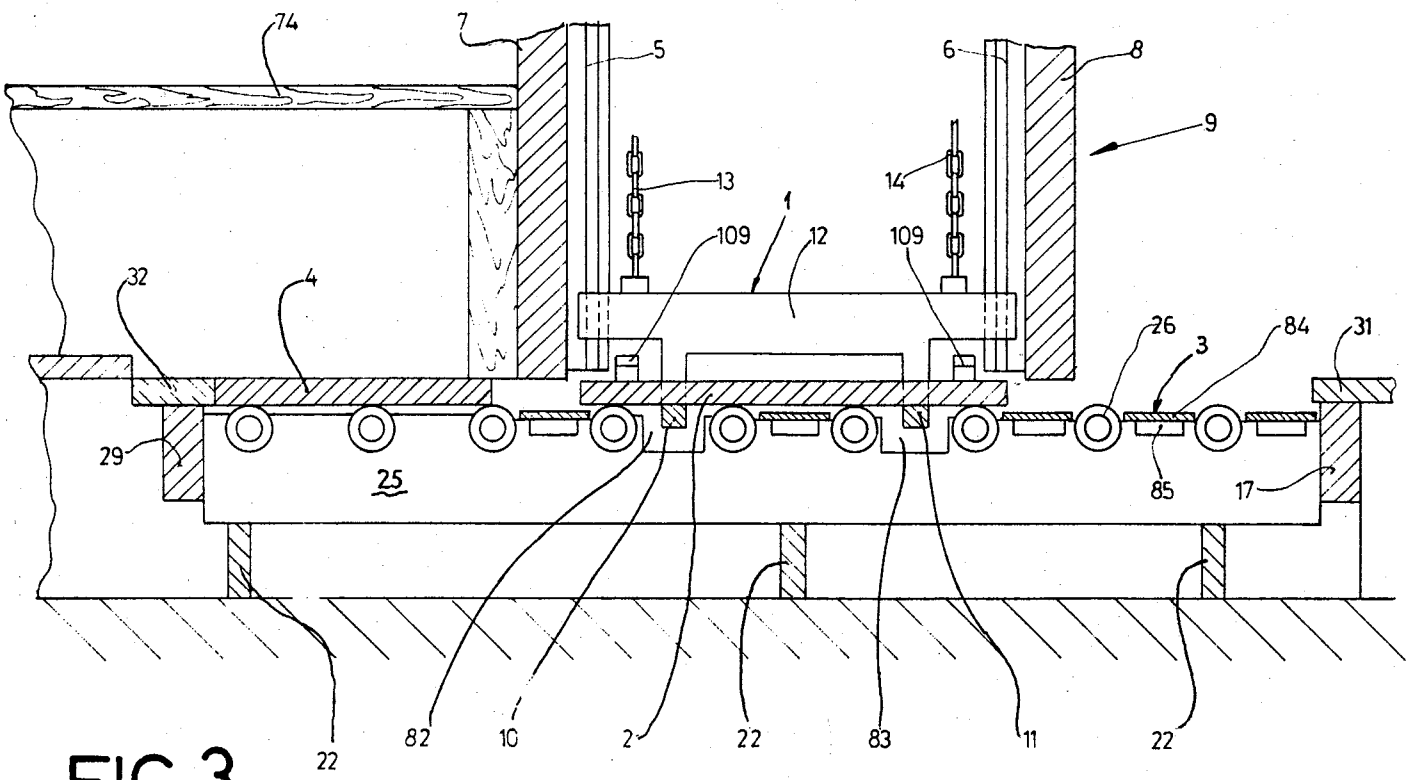
FIG. 3 is a cross-sectional view with portions in elevation for purposes of illustration taken along lines III—III of FIG. 1.

As best illustrated in FIG. 3, the conveyor means 1 has a crossbar 12 guided in guide channels or guide means 5 and 6 which are attached to frame members 7 and 8 of the device or press 9. The crossbar 12 supports a pair of blades 10 and 11, which are attached such as by being welded thereto, and form means for engaging a plate such as 2 and lifting it along the vertical path of the conveyor means 1. To hoist the crossbar 12 in its guides 5 and 6, chains such as 13 and 14 are attached to an appropriate drive means, which is capable of rapid movement along the vertical path as well as movement which is synchronized with the rate of depositing of sheets onto a pallet from the press 9 so that the pallet is gradually lowered as additional sheets are placed or stacked thereon.

The second conveyor means 3 (FIG. 1) has a pair of side frame members 15 and 16, which are held together at one end by a crossbar or member 17, which is secured to the member by screws 28 and at the opposite end by a base plate 18, which is attached to the members by fasteners such as screws 27. A separating wall or member 19 extends between the crossbar 17 and the base plate 18 and is held thereon by screws 20 and 21, respectively.

The separating wall 19 is connected to the one side frame member 15 by a series of crossbars or cross members 22 (only two are illustrated in FIG. 1) and also by a crossbar or member 29, which is secured to the members 15 and 19 by screws 30. The crossbars 22 support a running track 23, which is made up of two side guides or members 24 and 25, which support a plurality of rollers 26 that are free to rotate on their axles. The side guides 24 and 25 are secured on the crossbars 17 and 29 and both ends of the running track 23 have been provided with stop means in the form of step plates 31 and 32, which are adjustable and can be locked in selected positions by means of screws 33, which are received or extend through elongated slots 34. A stub 35 is secured on one side 36 of the separating member 19 by a threaded fastener such as a screw 37. The stub 35 supports a ball bearing 39, which, in turn, supports a sprocket gear 38 for rotation. The separating wall 19 adjacent the stop 31 supports a first end contactor 40, such as a limit switch and a second adjustable end contactor or limit switch 72 is mounted on the side frame member 16 adjacent the other end and the other stop means 32.

Figure 2:
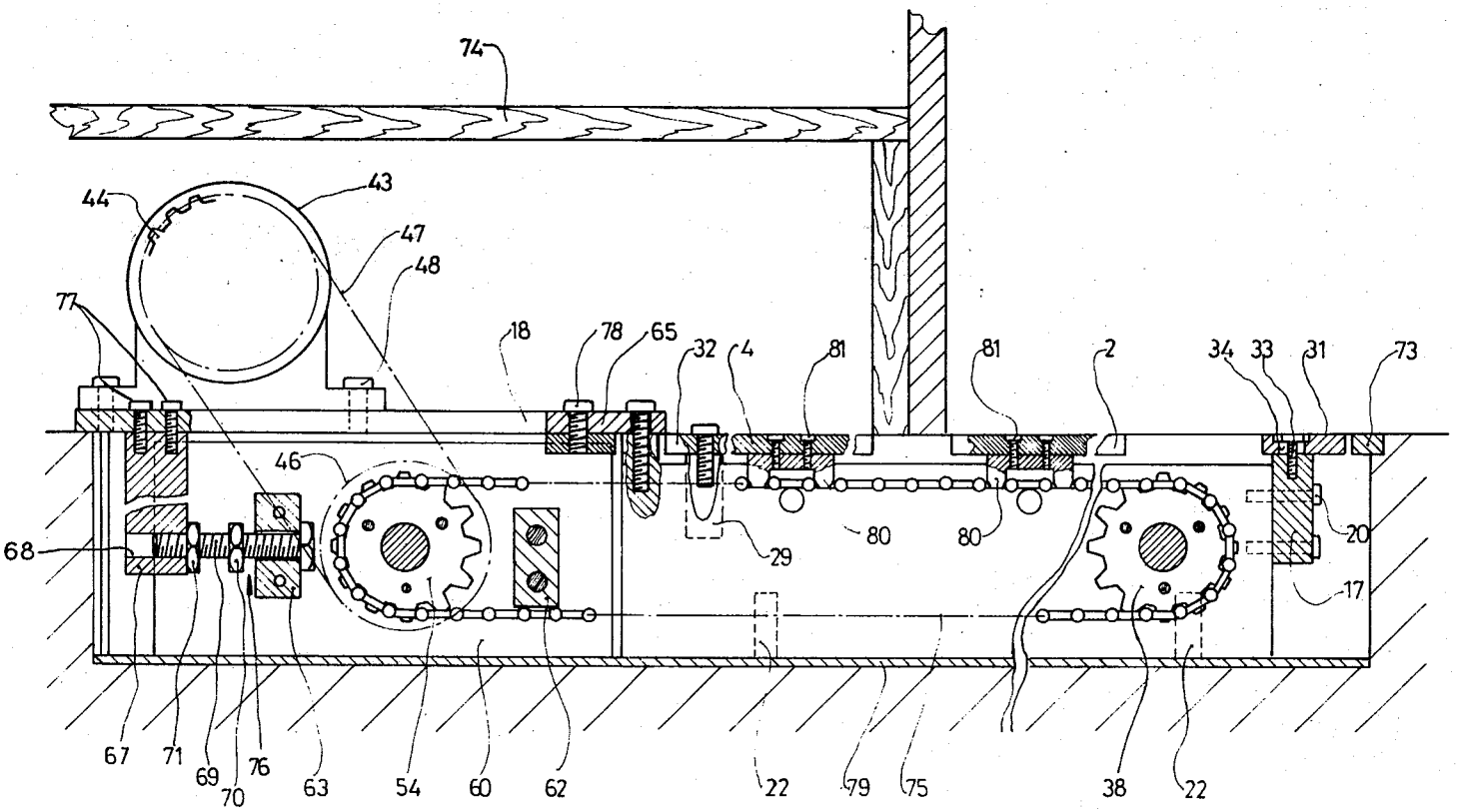
FIG. 2 is a cross-sectional view with portions in elevation for purposes of illustration taken along lines II—II of FIG. 1.

The base plate 18 supports a source of driving or rotational movement 41 for the drive means 42 for the second conveyor 3. The source of rotational movement 41 includes an electric motor 43 which can be driven in either a counterclockwise or clockwise direction. The motor 43 has a drive shaft on which an axle 45 is secured by way of a key 86 acted on by a pressure screw 87 (see FIG. 4). The axle 45 supports a tooth or sprocket wheel 44, which is aligned with another sprocket wheel 46 and drives the wheel 46 by means of a chain 47 (FIGS. 1 and 2). The tension in chain 47 can be properly set by shifting the motor 43 on the base plate 18 and by locking it in the desired position by means of screws 48. The sprocket wheel 46 (FIG. 5) is secured on an axle 49 by a pin 100 and the axle 49 is supported for rotation in a bore 59 of a slide guide 60 by a ball bearing 50 with the other end of the axle 49 being supported for rotation in a bore 55 of a flange member 56 by a ball bearing 51 which is held in the bore 55 by snap rings 57. The axle 49 has a flange 52 on which a sprocket wheel 54 is secured by means of threaded fasteners such as screws 53 (FIG. 1). The sprocket wheel 54 engages a chain 75, which extends to the tooth wheel or sprocket gear 38 on the stub 35 and forms the drive means 42 for the second conveyor means 3.

The slide guide 60 and the member 56 are held in spaced relation to each other by spacing members 62 and 63 and threaded fasteners 61. Thus, the slide guide 60 and the member 56 are mounted for sliding movement in guiding bars 64, 65, as well as guiding bars 66, 67 which are attached to the plate member 18 and, therefore, the slide guide 60 forms part of a chain tightener 76 (FIG. 2) for the chain 75 of the drive means 42. To adjust the position of the tightener 76 along a path defined by the guide bars or clamping bars 64, 65, 66 and 67, a threaded member 69 extends through an opening in the spacers 63 and is threadably engaged in a threaded bore 68 of the guide portion 67. A nut 70 is pinned on the threaded member 69 to enable controlling the threading thereof. A counter or lock nut 71 is also provided to hold the threaded member in the desired adjusted position. The arrangement for tightening slides on a panel such as 79 (FIG. 5) which is secured by a screw 101 to frame member 16. The entire assembly making up the second conveyor means is covered by a portion of a plate 73 (FIGS. 2 and 6) which is designed for protecting the various elements but has an opening so that the necessary parts of the conveyor 3 are exposed. In addition, as best illustrated in FIG. 2, a portion of the conveyor including the motor extends under a platform such as 74 or part of the frame of the platen press 9.

As best illustrated in FIG. 2, the sprocket wheels 38 and 54 are connected to one another by chain 75. The tension of the chain 75 is ensured by the tightener 76 which consists of the screws 69 which is threadably received in the bearing or guide 67 which is secured on the base plate 18 by screws 77. The clamping bars or guide bars 64 and 68 are also held against the base plate 18 by means of screws such as 78. The tightener 76 is slidable on the plate 79 which extends between the side frame member 16 and the separating wall 19. Both the plates 2 and 4 are provided with means to center and to interconnect the plate to the chain 75 of the drive means 42. These means are illustrated as claws 80 protruding from the bottom of the plates and secured thereto by screws such as 81. The claws or protruberances 80 become engaged in the links of the chain belt 75 to ensure that the plates 2 and 4, respectively, will move along with the chain.

As best illustrated in FIG. 3, the blades 10 and 11 of the cross member 12 of the first conveyor means 1 can extend between a pair of the rollers 26 and the frame members such as 15 and 25 are provided with recesses or cut-out portions such as 82 and 83. In addition, the gaps between adjacent rollers 26 is filled by a plate 84 which is supported on a member 85 that extends between the members 24 and 25.

Figure 4:
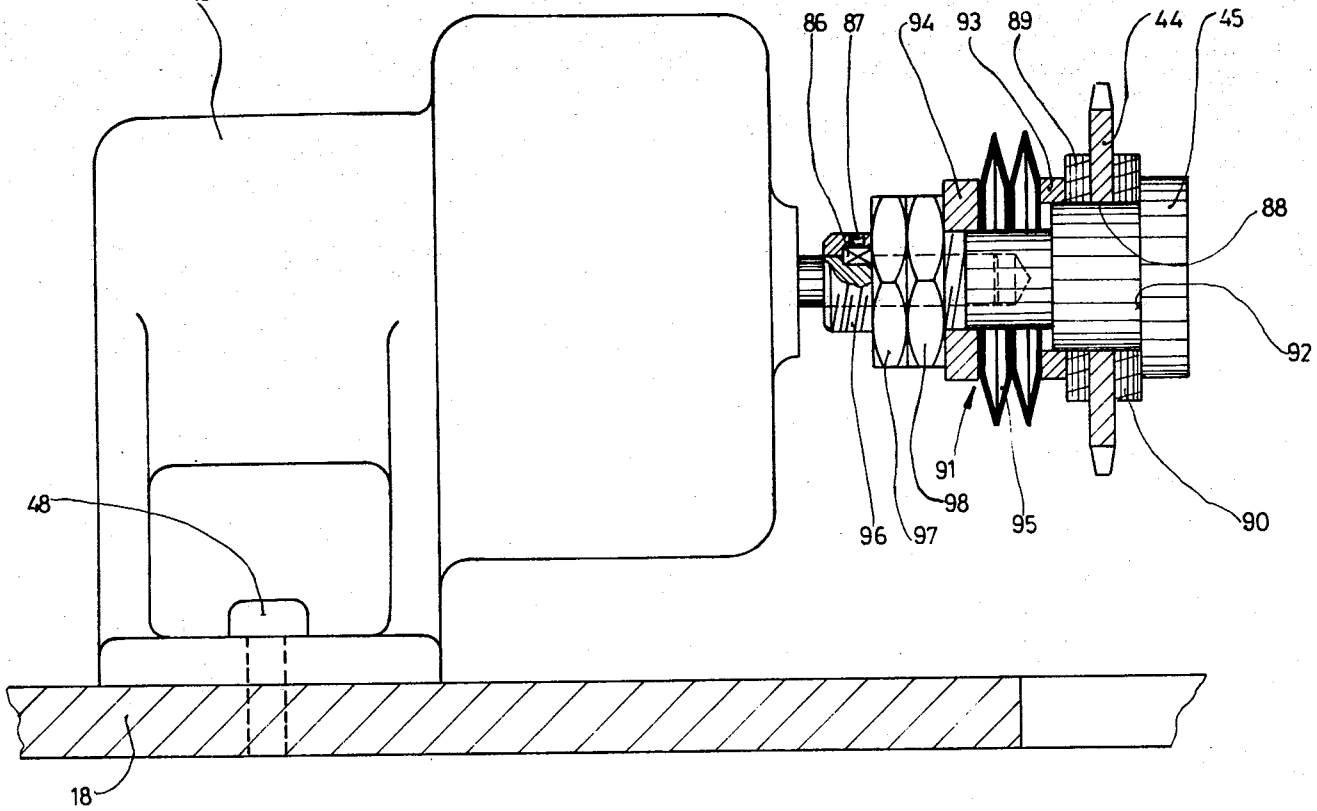
FIG. 4 is a cross-sectional view taken along lines IV—IV of FIG. 1 with portions in elevation for purposes of illustration.
Figure 5:
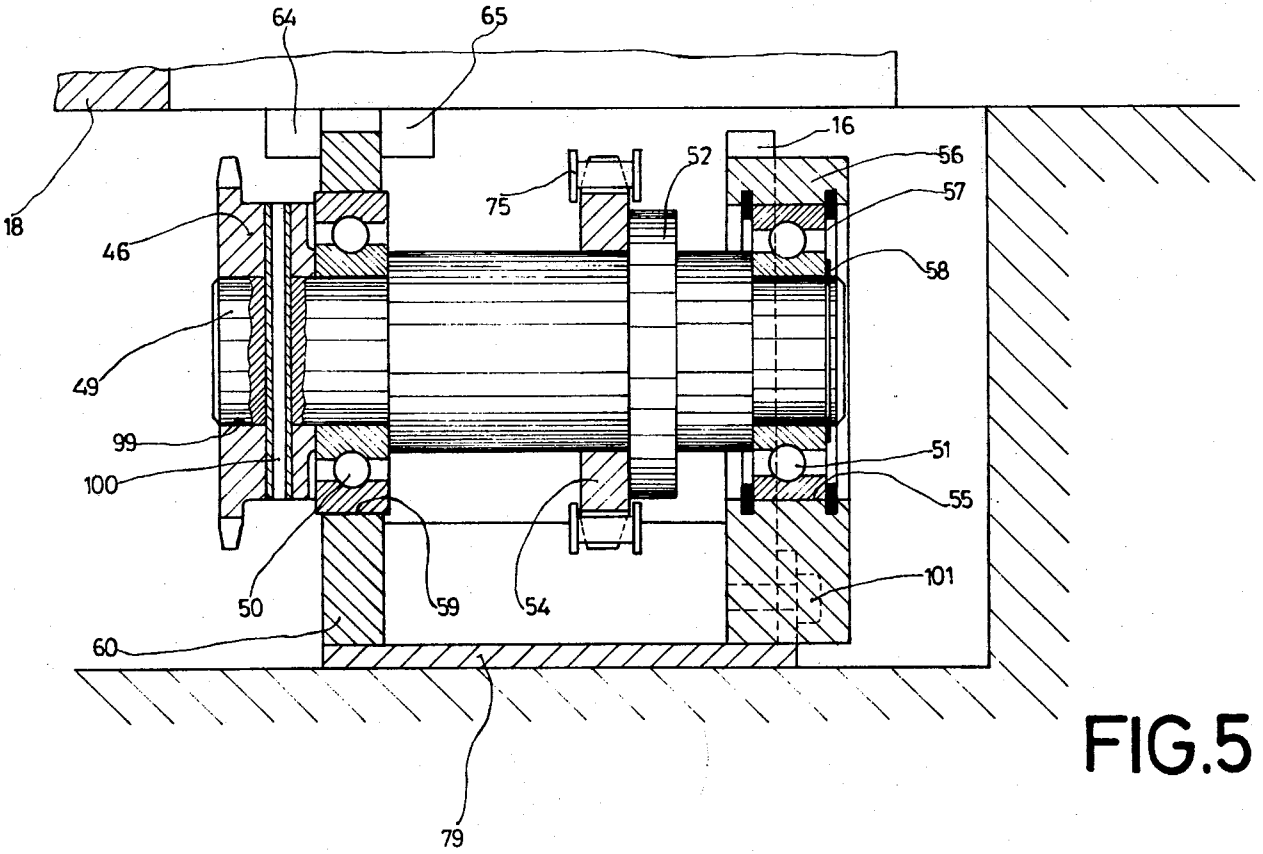
FIG. 5 is a cross-sectional view with portions in elevation for purposes of illustration taken along lines V—V of FIG. 1.

As best illustrated in FIG. 4, the axle 45 is provided with a portion 88 for receiving the sprocket wheel 44. Both sides of the sprocket wheel 44 have been provided with ferro-washers 89 and 90 with the washers 89 and 90 being entrapped between a shoulder 92 of the axle 45 and a clamping means 91 which consists of pressure rings 93 and 94 with spring washers 95 interposed therebetween. This group is held by nuts 97 and 98 to maintain a desired pressure on the ferro-washers 89 and 90 to press against the side of the sprocket wheel 44 and hold it to rotate with the shaft 45. This arrangement basically forms a friction clutch, which will allow the sprocket wheel to rotate on the axle 95 in the event of a jamming of the drive means.

Figure 6:
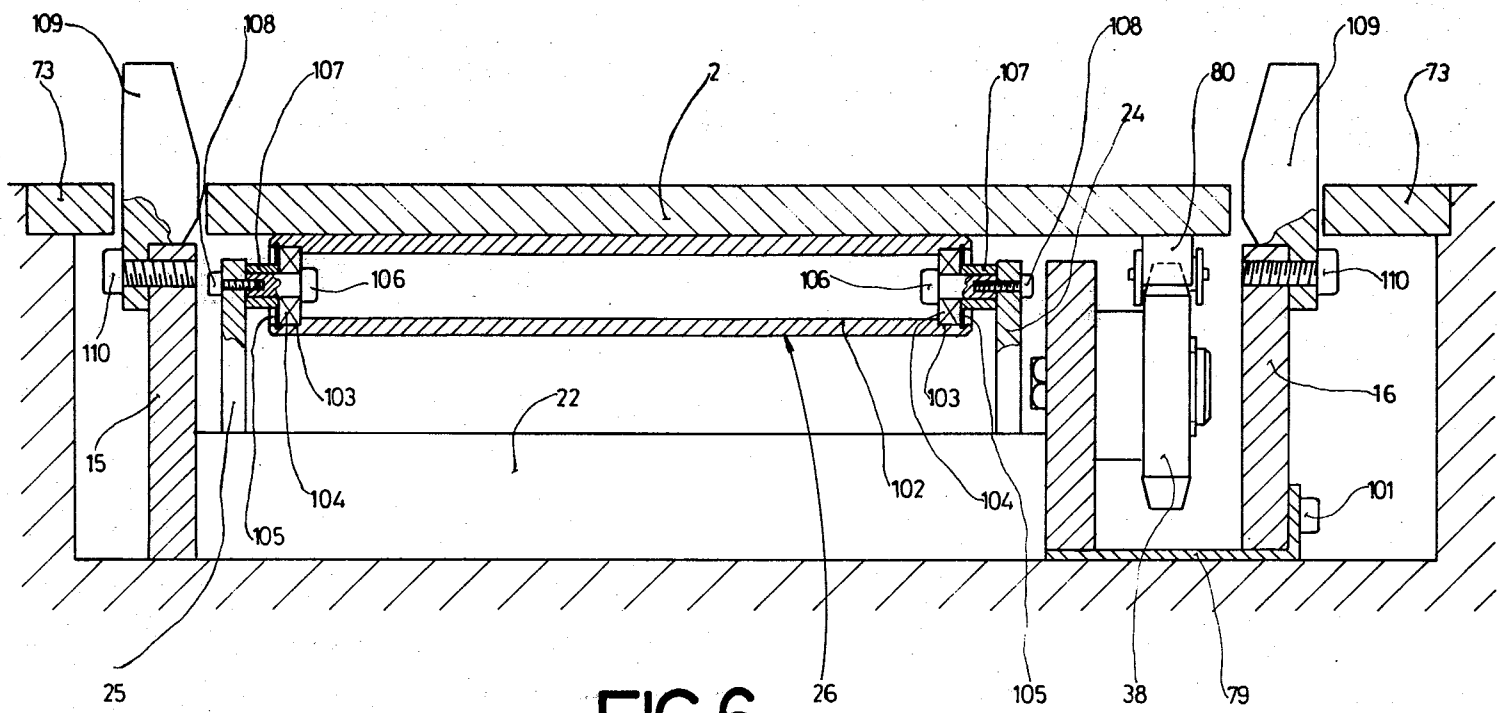
FIG. 6 is a cross-sectional view taken along lines VI—VI of FIG. 1 with portions in elevation for purposes of illustration.

As mentioned hereinbefore, a plurality of rollers 26 extend between the side frame members 24 and 25. As best illustrated in FIG. 6, each of the rollers 26 is mounted in the frames 24 and 25 to be free to rotate on its axis. Each of the rollers 26 includes a sleeve 102, which has a recess 103 at each end to receive a separate ball bearing 104. The ball bearings 104 are retained in the recesses 103 by snap rings such as 105 and are received on an axle 106 and held with a spacing bushing 107 so that the roller 26 will be in proper spaced relationship to the frame members 24 and 25. Each of the axles 106 is secured on its respective side or frame member 24 or 25 by a threaded fastener such as a screw 108. To ensure that each of the plates, whether it is plate 2 or plate 4, as it is being lowered back onto the second conveyor 3 is properly aligned so that the claw 80 will be engaged in the chain belt 75, centering means comprising four centering blocks 109 (see FIGS. 6 and 13) are provided. As illustrated in FIG. 6, the blocks 109 are secured on the side members 15 and 16 by threaded fasteners such as machine screws 110.

As best illustrated in FIG. 13, the plates 2 and 4 are moved along the second conveyor means 3 between three aligned positions. In FIG. 13, the plate 2 is in a first or one position designated as position A which is in the vertical path of the first conveyor means 1. The plate 4 is in a second position B, which is a ready position or standby position and the third position is on the other side of position A and is an unloading position or station C. When a plate such as 4 is in the second position B, it will be engaged against stop means 32 and will engage a limit switch such as 72. In a similar manner, when one of the plates, either 2 or 4, moves into the third position C, it will engage the stop means 31 and also limit switch 40.

It should be noted that the movement of the sheets through the platen press 9 is in the direction of arrow 118 until they are received on a pallet of the first conveying means which moves in a vertical path which extends perpendicular to the position A as illustrated in FIG. 13.

Figure 7:
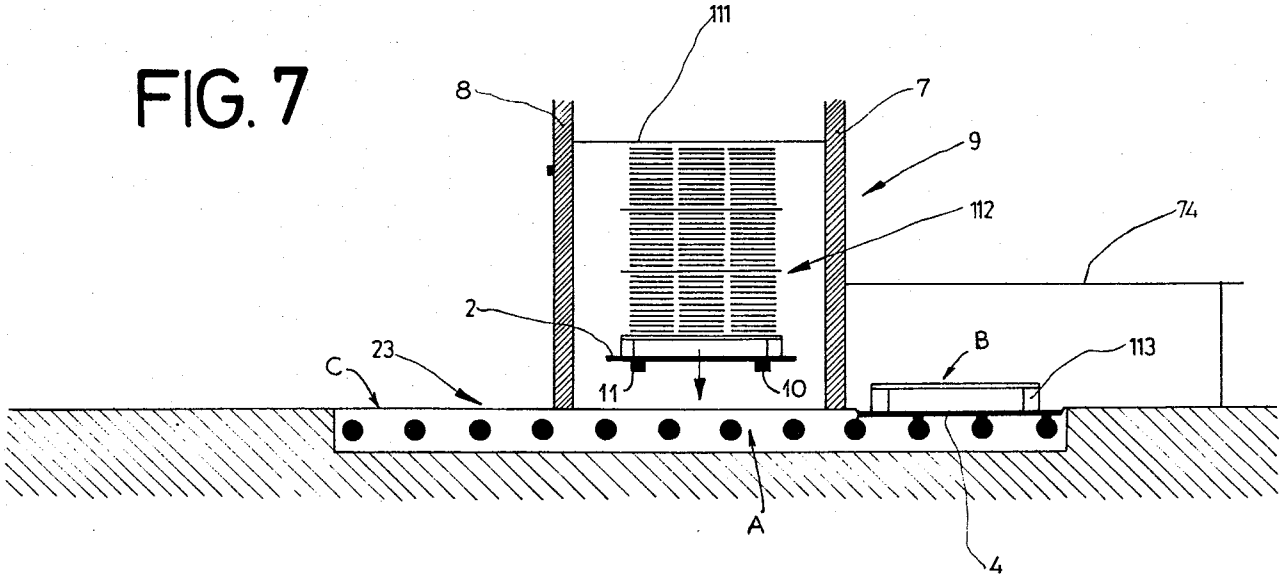
FIGS. 7–12 are schematic side views illustrating the various steps in the operation of the device with FIG. 7 illustrating a loaded pallet being lowered onto the second conveyor; with FIG. 8 illustrating the loaded pallet being transferred to an unloading station and an empty pallet being moved to the first conveyor; with FIG. 9 illustrating the loaded pallet at the unloading station of the second conveyor and an empty pallet being raised by the first conveyor; with FIG. 10 illustrating the removal of the loaded pallet and the stacking of sheets on the empty pallet in the first conveyor; with FIG. 11 illustrating the loading of an empty pallet on the second conveyor and the continued loading of the pallet in the first conveyor; and with FIG. 12 illustrating moving the new empty pallet from the unloading station through the first conveyor to a standby station.
Figure 8:
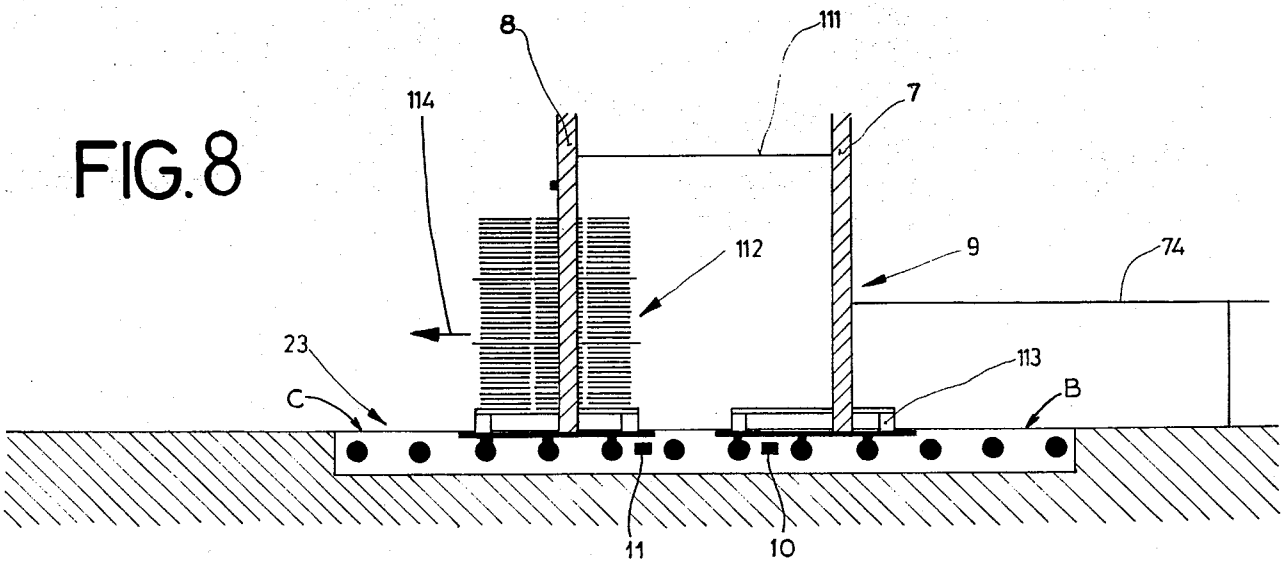

Operation of the device is best illustrated schematically in FIGS. 7–12. In FIG. 7, a substantially full pallet 112 which rests on the plate 2 supported on the blades 10 and 11 is being lowered in the direction of the arrow. Assuming that the stack or pile on the pallet 112 has reached the maximum height, an interruption device, which is not illustrated but situated above a line 111 starts receiving the sheets. Empty pallet 113 on the sheet 4 is in the standby station or position B which is the second position.

In the next step after the pallet 112 and plate 2 have been placed on the conveyor 23 (FIG. 8), the conveyor 3 is energized so that the loaded pallet 112 is moved in the direction of arrow 114 from the one station A to the third position which is a withdrawal or unloading station C. At the same time, the plate 4 with the unloaded pallet 113 is moved from the ready station B of the second position to the one position to be engaged by the blades 10 and 11 of the lifting means of the first conveyor. During this time, sheets being delivered by the platen press 9 are being received in the interruption device which is above the line 111. It should also be noted that blades 10 and 11 are disposed between the rollers as best illustrated in FIG. 3.

Figure 9:
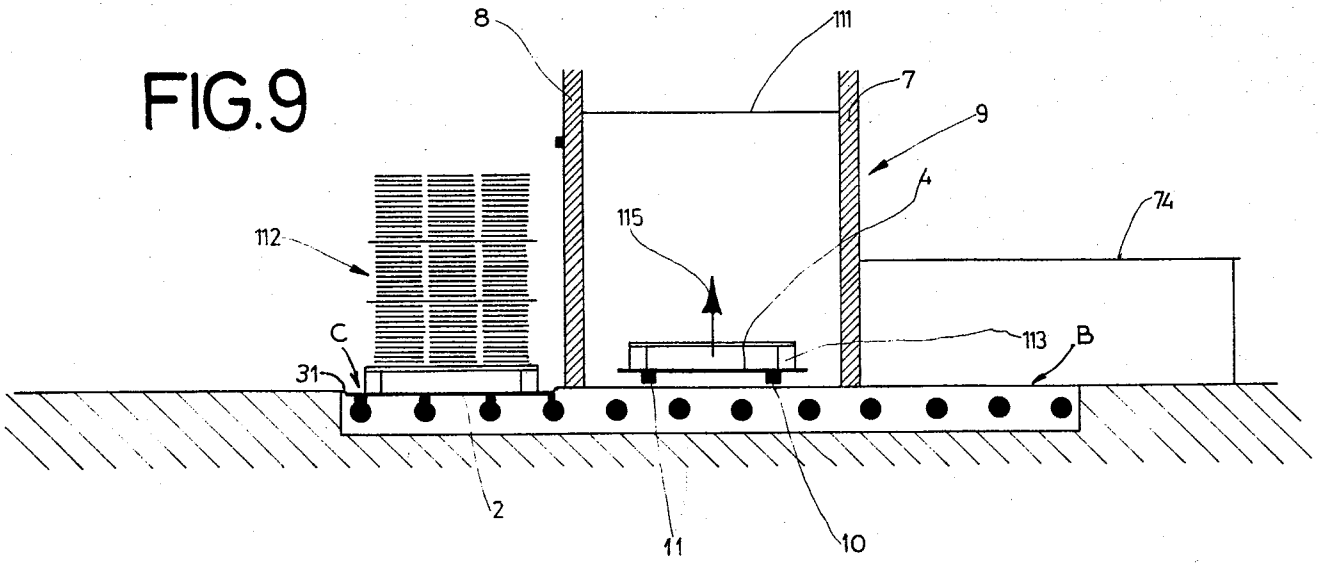

As illustrated in FIG. 9, the movement of the platen 112 is fully withdrawn into the third position which is the unloading station C with the plate 2 engaging the stop 31. At this time, the plate 4 having the unloaded platen 113 is engaged by the blades 10 and 11 and is being lifted rapidly in the direction of arrow 115 toward the line 111. It should be noted that when the plate 2 engages the stop 31, it also engaged the limit switch or contactor 40 which, in addition to stopping movement of the second conveyor, can be utilized to actuate the first conveyor to cause the movement of the blades in the direction of the arrow 115.

Figure 10:
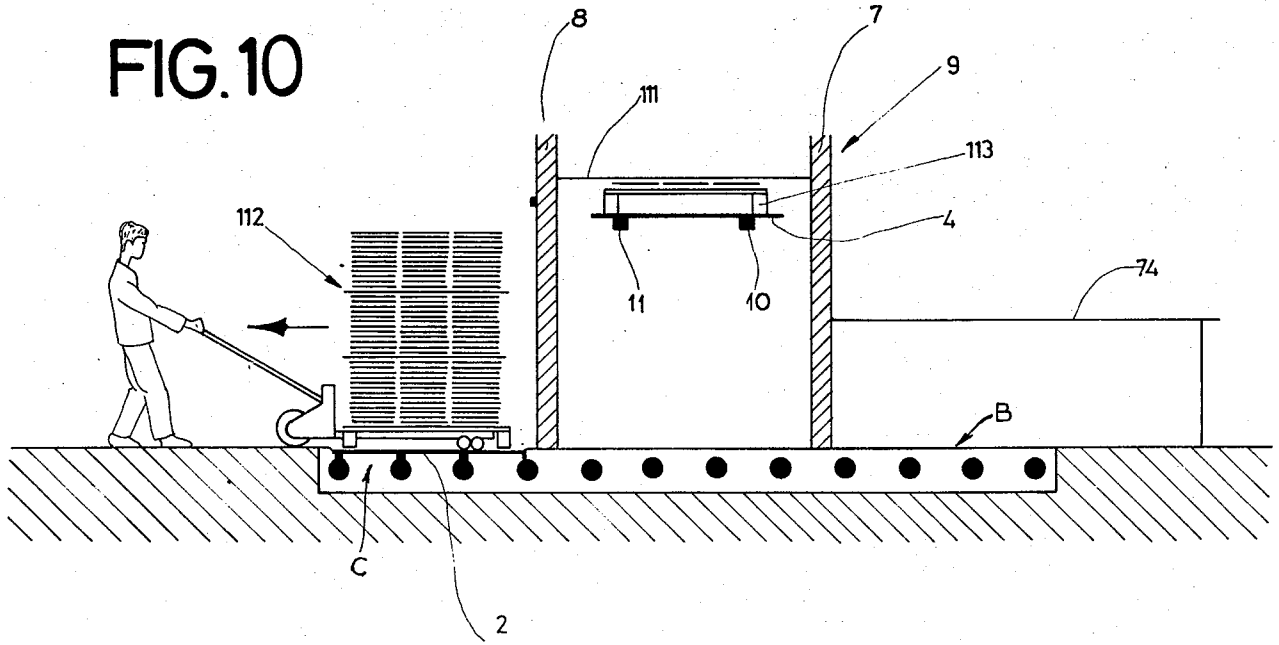

In FIG. 10, a worker is unloading the loaded pallet 112 from the unloading station C and the previously unloaded or empty pallets 113 on the plate 4 is moved up to line 111 to receive the pile of sheets accumulated in the interruption device and to be gin its descent in a vertical path as additional sheets are deposited thereon. It is noted that this descent is synchronized with the receiving of the sheets from the press 9.

Figure 11:
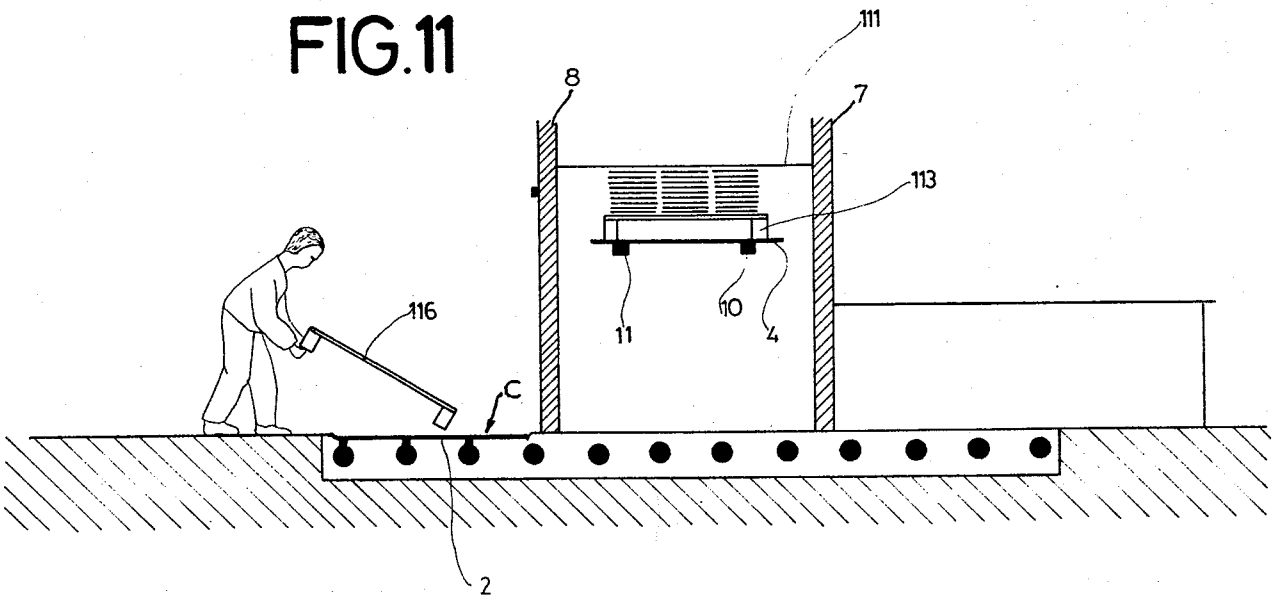

In FIG. 11 a worker is loading a new empty pallet 116 on the plate 2, which is in the third position which is the unloading station C. At the same time, the plate 4 with previously unloaded pallets 113 is being gradually loaded with a pile of blanks or sheets building up thereupon.

Figure 12:
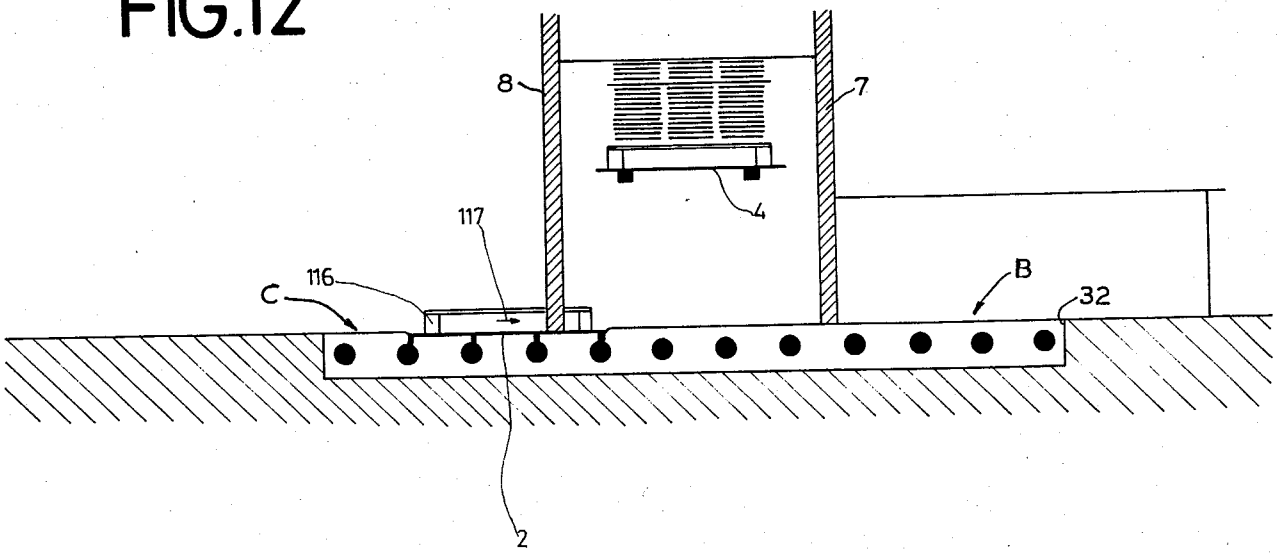

As illustrated in FIG. 12, after placing a new pallet 116 on the plate 2, the second conveyor means is energized to transport the plate 2 and the new pallet 116 in the direction of arrow 117 from the third position through the one position A to the second position to be in the ready or standby station B as illustrated and previously described in FIG. 7. As the plate 2 moves into the second position, the device is ready to repeat the unloading and loading cycle.

As illustrated in FIG. 13, limit switches are placed in various positions of the second conveyor means 3. In addition, other limit switches may be located along the path of the first conveyor means 1 so that appropriate control signals can be generated when the blades such as 10 and 11 reach various positions such as the lowermost position illustrated in FIG. 8 or the uppermost position illustrated in FIG. 10. By proper utilization of the various signals utilizing conventional control means, the second conveyor will not be energized until the blades 10 and 11 are in the position of FIG. 8. In a similar manner, after the limit switch 40 is contacted by the plate 2 when it assumes a position of FIG. 9, the second conveyor means 3 is stopped and the first conveyor means is started to transport the plate 4 and pallet 113 upward in a vertical direction toward a line 111. If desired, some sort of switch means or sensing means can be utilized to sense the clearance of the blades 10 and 11 from a position adjacent the second conveyor means so that the plate 2 with the newly applied empty pallet 116 can be shifted from the third position through the one position to the second position. In view of the fact that this shifting will depend on unloading the loaded pallet 112 and applying an empty pallet 116, it is advisable to have the movement of the plate 2 in the direction of arrow 117 (FIG. 12) initiated by an operator actuated switch such as a pushbutton. When the plate 2 contacts the limit switch 72, it produces a stop signal for the second conveyor means 3 so that the drive is disengaged as the plate 2 engages stop means 32.

Although various minor modifications may be suggested by those versed in the art, it should be understood that I wish to embody within the scope of the patent warranted hereon, all such modifications as reasonably and properly come within the scope of my contribution to the art.

I claim:

1. A device for automatically receiving sheets in a pile at a delivery station of a sheet processing apparatus and removing a completed pile of sheets, said device including first conveyor means for transporting a pallet along a vertical path and including means for lowering the pallet along said vertical path as sheets are deposited at the delivery station and received thereon; and a second conveyor means for transporting a pallet in a horizontal path between at least two positions with one of said positions being in the path of the first conveyor and the other position being removed therefrom, said second conveyor means including two side frames supporting a running track therebetween, at least two plates disposed on said track for transporting a respective pallet therealong, drive means for transporting said plates along said track, stop means disposed at each end of said track for bringing each plate to rest at the end of the track, said plates and drive means having releasable means coacting to center the plates on said track and to interconnect the plates with said drive means, said first conveyor means having means for engaging a plate positioned in said one position and for lifting the plate and any pallet supported thereon from said second conveyor for transportation along said vertical path, and said second conveyor means having means for controlling the drive means of the second conveyor means so that the plates with pallets are moved into and out of said one position to be engaged by the first conveyor.

2. A device according to claim 1, wherein the means for engaging and lifting of the first conveyor means consists of two blades connected by a crossbar, said crossbar and blades being moved along said vertical path by a drive means including control chains, said drive means of the first conveyor means being capable to lower the blades in synchronization with the arrival of sheets for depositing on a pallet supported on the plate on said blades, and being independently actuatable for transporting a plate and empty pallet disposed on said blades from a lowermost position toward the upper position at a higher rate of speed.

3. A device according to claim 2, wherein the second conveyor means is disposed beneath the first conveyor means and extends along a path extending perpendicularly thereto with portions disposed on each side of the vertical path of the first conveyor means so that as a plate with a full pallet is being transported from the one position in the path of the first conveyor means, a plate containing an empty pallet is being transported into the one position for engagement by the blades.

4. A device according to claim 3, wherein the running track comprises a series of rollers arranged one after another on said side formed by means for supporting each of said rollers for rotation on an axis of rotation.

5. A device according to claim 4, wherein the drive means of said second conveyor comprises a chain extending along side of and spaced from the running track, each of said plates being supported on the rollers of said running track as the releasable means engages said chain to interconnect each plate to the drive means.

6. A device according to claim 1, wherein the plates are arranged in appropriate succession on said running track.

7. A device according to claim 1, wherein the drive means of the second conveyor includes a drive chain, and said releasable means includes a claw protruding from a bottom surface of each of said plates engaging a length of the conveyor chain so that the plate is interconnected with said drive chain to move therewith.

8. A device according to claim 7, wherein the running track includes a plurality of rollers mounted for rotation so that a plate having its claw engaged on the drive chain is supported by said rollers as it moves along said running track.

9. A device according to claim 1, wherein said control means for the drive means includes switch means adjacent each end of the track engaged by a plate as the plate engages the stop means so that the drive means is stopped as the plate engages the stop means.

10. A device according to claim 1, which includes means for centering the plate being lowered by the first conveyor means onto the second conveyor means, said means for centering including blocks disposed on the frame of the second conveyor means for engaging the plate to shift it to a position so that the releasable means is aligned to interconnect the drive means and plate together.

11. A device according to claim 1, wherein th drive means of the second conveyor means includes an electric motor operable in two directions, said control means energizing said motor to operate in one direction to withdraw a loaded pallet from the one position in the vertical path and to insert an empty pallet on a second plate from a slanted position into said one portion and subsequently to operate in an opposite direction to move an empty pallet disposed on the unloaded plate to the standby position.

12. A device according to claim 1, wherein the second conveyor means has three positions aligned in a row and includes a second position on one side of the one position for holding an empty pallet in standby for introduction to said one position for engagement by the first conveyor, and a third position on the opposite side of the one position for unloading a loaded pallet from the plate, said drive means being reciprocal in two directions so that as a loaded pallet is moved from the one position to the third position, an unloaded pallet and plate are moved from the second position to the one position, and said drive means being movable in the opposite direction after the unloaded pallet has been raised along the vertical path of the first conveyor means so that an empty pallet placed on the plate in the third position can be transported through the one position to the second position to be ready for subsequent loading in the first conveyor.

* * * * *